US007708596B2

(12) United States Patent
Puschkat

(10) Patent No.: US 7,708,596 B2
(45) Date of Patent: May 4, 2010

(54) AUTOMOTIVE ELECTRICAL CONNECTOR SYSTEM AND METHOD OF ASSEMBLING SAME

(75) Inventor: Peter Puschkat, Waltrop (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/140,547

(22) Filed: Jun. 17, 2008

(65) Prior Publication Data

US 2009/0023334 A1 Jan. 22, 2009

(30) Foreign Application Priority Data

Jul. 17, 2007 (DE) ..... 10 2007 033 263

(51) Int. Cl.
*H01R 13/68* (2006.01)

(52) U.S. Cl. ..... 439/620.27; 439/724

(58) Field of Classification Search ..... 439/620.27, 439/620.26, 723, 724
See application file for complete search history.

(56) References Cited

U.S. PATENT DOCUMENTS 4,221,455 A * 9/1980 Cairns et al. ..... 439/355
5,438,310 A * 8/1995 Ikari ..... 337/208
5,841,338 A 11/1998 Yasukuni
6,007,350 A * 12/1999 Isshiki ..... 439/76.2
6,126,457 A 10/2000 Smith et al.
6,178,106 B1 * 1/2001 Umemoto et al. ..... 363/146
6,482,040 B1 * 11/2002 Brooks ..... 439/620.27
6,558,198 B2 * 5/2003 Kobayashi et al. ..... 439/620.29
6,759,938 B2 * 7/2004 Matsumura et al. ..... 337/161
6,824,430 B2 * 11/2004 Matsumura et al. .... 439/620.29
6,830,482 B2 * 12/2004 Matsumura et al. .... 439/620.27

FOREIGN PATENT DOCUMENTS

DE 19745857 * 4/1998
DE 19742585 A1 6/1999
DE 10232650 B4 4/2006
EP 1548787 A1 12/2004
JP 2002358866 A 12/2002

OTHER PUBLICATIONS

DE Office Action dated Mar. 11, 2008 with English translation thereof.

* cited by examiner

*Primary Examiner*—Neil Abrams
(74) *Attorney, Agent, or Firm*—Brooks Kushman P.C.

(57) ABSTRACT

Different configurations of power distribution boxes are assembled from a common set of components. A housing may receive any of several bus assemblies having taps of differing configurations. A fuse holder that protects portions of a bus assembly inserted into the housing is attached with the housing.

7 Claims, 4 Drawing Sheets

AUTOMOTIVE ELECTRICAL CONNECTOR SYSTEM AND METHOD OF ASSEMBLING SAME

CROSS-REFERENCE TO RELATED APPLICATIONS

This application claims priority to German Application No. 10 2007 033 263.9, filed on Jul. 17, 2007, the disclosure of which is hereby incorporated by reference in its entirety.

BACKGROUND OF THE INVENTION

1. Field of the Invention

The invention relates to electrical connector systems and methods of assembling the same.

2. Discussion

Electrical connectors of automotive vehicles may connect a power source, e.g., a battery, with a wiring harness. The wiring harness may include several electrical leads that electrically connect with devices that require power. Different wiring harnesses may require different electrical connectors.

SUMMARY OF THE INVENTION

Embodiments of the invention may take the form of an electrical connector for a wiring harness of an automotive vehicle. The electrical connector includes an electrical bus having a row of contacts and a housing including a row of slots configured to receive the row of contacts.

Embodiments of the invention may take the form of an electrical connector for a wiring harness of an automotive vehicle. The electrical connector includes an electrical bus having a row of contacts selected from the group including mega contact and mini contact. Each of the contacts has an insertion portion. The insertion portion of the mega contact is different than the insertion portion of the mini contact. The electrical connector also includes a housing including a row of openings configured to receive the insertion portions of the row of contacts. At least one of the openings is configured to receive the insertion portion of any of the contacts selected from the group including mega contact and mini contact.

Embodiments of the invention may take the form of a method of assembling an electrical connector for a wiring harness of an automotive vehicle. The method includes selecting an electrical bus having a row of contacts. The contacts are selected from the group including input tap, first output tap, and second output tap. The method also includes inserting the row of contacts of the electrical bus into a row of openings of a housing configured to receive the row of contacts.

While exemplary embodiments in accordance with the invention are illustrated and disclosed, such disclosure should not be construed to limit the claims. It is anticipated that various modifications and alternative designs may be made without departing from the scope of the invention.

DETAILED DESCRIPTION

A variety of power distribution boxes, e.g., electrical connectors, may be assembled from a common set of components. This common set of components may allow a manufacturer to reduce, for example, the cost associated with developing application specific power distribution boxes by reducing the number of unique components necessary to support such application specific power distribution boxes.

Figure 1:
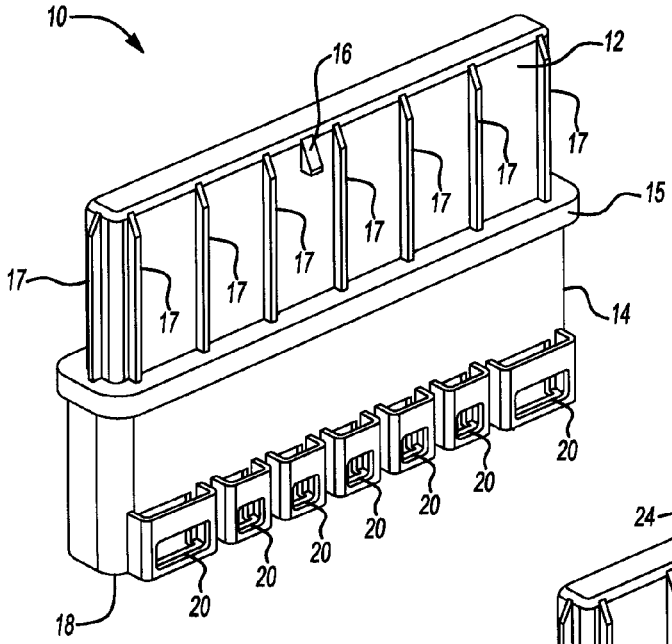
FIG. 1 is a perspective view of an example power distribution box.

FIG. 1 is a perspective view of power distribution box 10. Power distribution box 10 includes fuse holder 12 and housing 14. Fuse holder 12 includes clip feature 16 which permit covers, discussed below, to attach with alternative embodiments of fuse holder 12. Fuse holder 12 also includes rim 15 that snaps to snap feature 21 of housing 14. Ridges 17 provide desirable structural properties, e.g., stiffness, for fuse holder 12. Power distribution box 10 also includes other components, discussed below, that enable it to electrically connect, for example, with wiring harness 43 (FIG. 4) of an automotive vehicle. The wiring harness may be inserted into end 18 of housing 14 and snapped to housing 14 at snap features 20.

Figure 2:
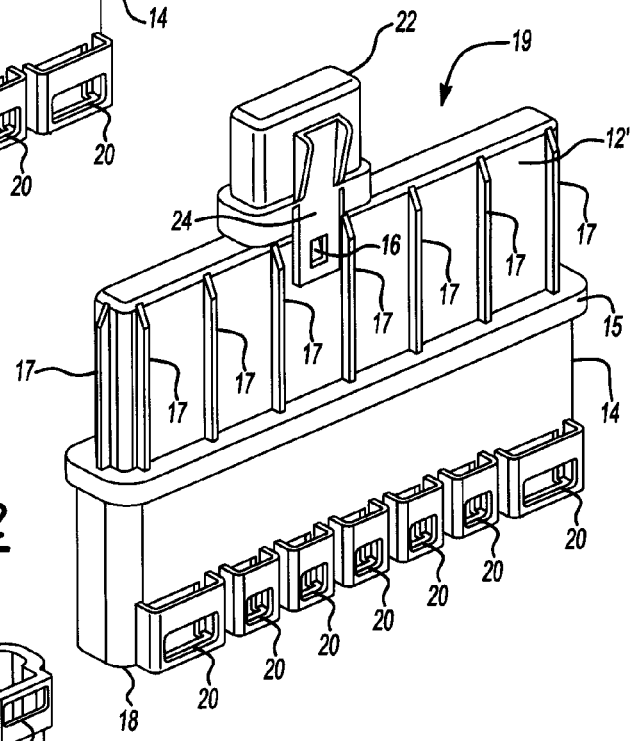
FIG. 2 is a perspective view of another example power distribution box.
Figure 4:
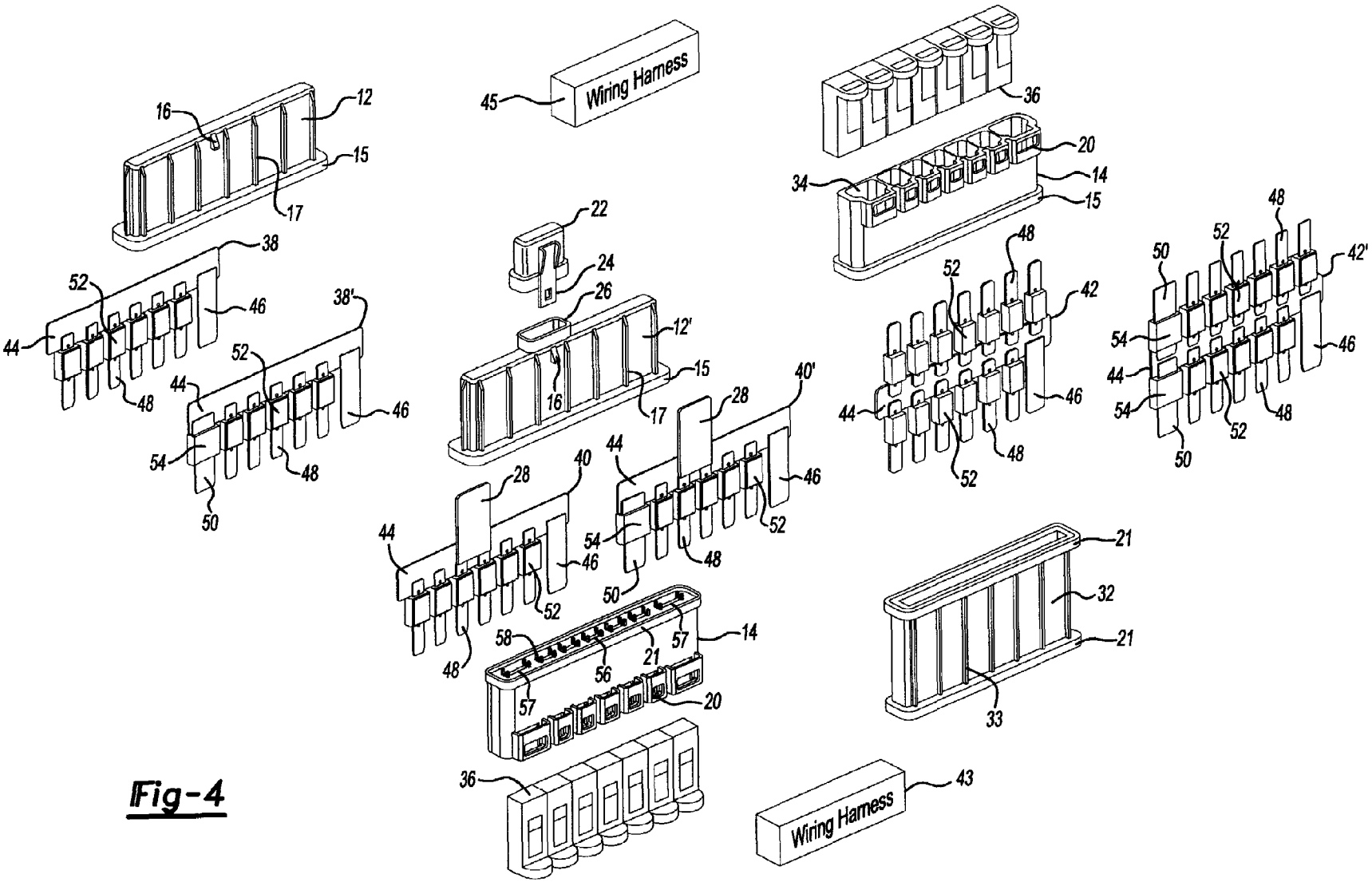
FIG. 4 is an exploded view of a construction kit used to assemble the power distribution boxes of FIGS. 1-3.

FIG. 2 is a perspective view of power distribution box 19. Power distribution box 19 includes fuse holder 12', housing 14, and cover 22. Cover 22 includes clip 24 which may be clipped with clip feature 16 of fuse holder 12'. Fuse holder 12' may be made from the same tool as fuse holder 12 but includes throughway 26 (FIG. 4). Throughway 26 mates with cover 22 and allows jumper bar 28 (FIG. 4) to pass through it. As discussed with reference to FIG. 1, power distribution box 19 also includes other components, discussed below, that enable it to electrically connect, for example, with wiring harness 43 (FIG. 4) of an automotive vehicle.

Figure 3:
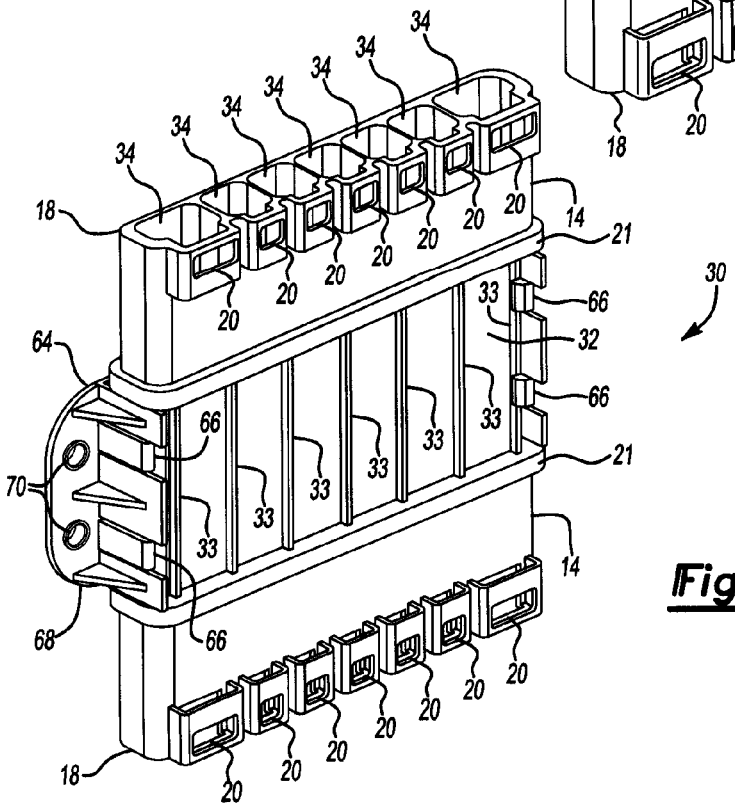
FIG. 3 is a perspective view of still another example power distribution box.

FIG. 3 is a perspective view of power distribution box 30. Power distribution box 30 includes fuse holder 32 and housings 14, 14. Fuse holder 32 includes rim 35 that snaps to snap feature 21 of housing 14. Ridges 33 provide desirable structural properties, e.g., stiffness, for fuse holder 32. As discussed with reference to FIG. 1, power distribution box 30 also includes other components, discussed below, that enable it to electrically connect, for example, with wiring harnesses 43, 45 (FIG. 4) of an automotive vehicle. Each of housings 14 include openings 34. Openings 34 may receive connector terminals 36 (FIG. 4). Connector terminals 36 mate with components within fuse holder 32 and a wiring harness. Power distribution box 30 of FIG. 3 is shown with bracket 64 discussed below.

FIG. 4 is an exploded view of a construction kit used to assemble power distribution boxes 10, 19, 30 (FIG. 3). In the embodiment of FIG. 4, power distribution boxes 10, 19, 30 share certain components, e.g., housing 14, etc., such that, as described below, several components can be mixed and matched to produce an array of different power distribution boxes. For example, fuse holder 12, housing 14, connector terminals 36, and either of bus assemblies 38, 38' may be assembled to form power distribution box 10. Fuse holder 12', housing 14, cover 20, connector terminals 36, and either of bus assemblies 40, 40' may be assembled to form power distribution box 19. Housings 14, 14, fuse holder 32, connector terminals 36, 36, and either of bus assemblies 42, 42' may be assembled to form power distribution box 30.

Housing 14 and fuse holders 12, 12', and 32 of FIG. 4 may protect bus assemblies 38, 38', 40, 40', 42, 42' from the surrounding environment. Housing 14 and connector terminals 36 provide structure, e.g., snap features, to which wiring harnesses 43, 45 may attach.

In the embodiment of FIG. 4, housing 14, fuse holders 12, 12', 32, and cover 22 are molded, e.g., injection molded, in plastic. Other manufacturing techniques may also be used. As discussed above, fuse holders 12, 12' share common tooling which reduces the number of tools necessary to produce parts for the power distribution boxes.

FIG. 5 is a perspective view of bus assembly 40'. Bus assembly 40' includes jumper bar 28, bus bar 44, blind tap 46, midi-taps 48, mega-tap 50, midi-fuses 52, and mega-fuse 54. In the embodiment of FIG. 5, bus assembly 40' includes five (5) midi-taps 48 and one (1) mega-tap 50. In other embodiments, bus assembly 40' may include more or less than one (1) mega-tap 50 and more or less than five (5) midi-taps.

Jumper bar 28 is electrically connected with bus bar 44 and provides an attachment point, after removing cover 22 (FIG. 2), for a jumper cable. Midi-taps 48 and midi-fuses 52 are electrically connected with bus bar 44. Midi-fuses 52 act as typical fuses for electrical taps of electrical connectors. In the embodiment of FIG. 5, midi-taps 48 are mechanically joined with bus bar 44 via, for example, a riveting process. In other embodiments, midi-taps 48 may be adhered or bonded with bus bar 44. Mega-tap 50 and mega-fuse 54 are electrically connected with bus bar 44. Mega-fuse 54 acts as a typical fuse for an electrical tap of an electrical connector. In the embodiment of FIG. 5, mega-tap 50 is mechanically joined with bus bar 44 via, for example, a riveting process. In other embodiments, mega-tap 50 may be adhered or bonded with bus bar 44.

In the embodiment of FIG. 5, blind tap 46, e.g., input tap, provides for an electrical input from, for example, a vehicle battery to power distribution box 12'. In the embodiment of FIG. 5, blind tap 46 is larger, e.g., wider, than midi-taps 48 and therefore may pass a greater amount of power relative to midi-taps 48. Midi-taps 48 and mega-tap 50, e.g., output taps, provide for an electrical output from power distribution box 12'. In the embodiment of FIG. 5, mega-tap 50 is larger, e.g., wider and thicker, than midi-taps 48 and therefore may pass a greater amount of power relative to midi-taps 48. In other embodiments, the relative shape, e.g., rectangular, triangular, hemispherical, etc., and size, e.g., large, small, wide, narrow, etc., of blind taps 46, midi-taps 48, and mega-taps 50 may vary depending on the application requirements.

Referring to FIG. 4, bus assembly 38' differs from bus assembly 40' at least because bus assembly 38' lacks jumper bar 28. Bus assembly 40 differs from bus assembly 40' at least because bus assembly 40 lacks mega-tap 50 and mega-fuse 54. Bus assembly 38 differs from bus assembly 38' as least because bus assembly 38 lacks mega-tap 50 and mega-fuse 54.

Figure 5A:
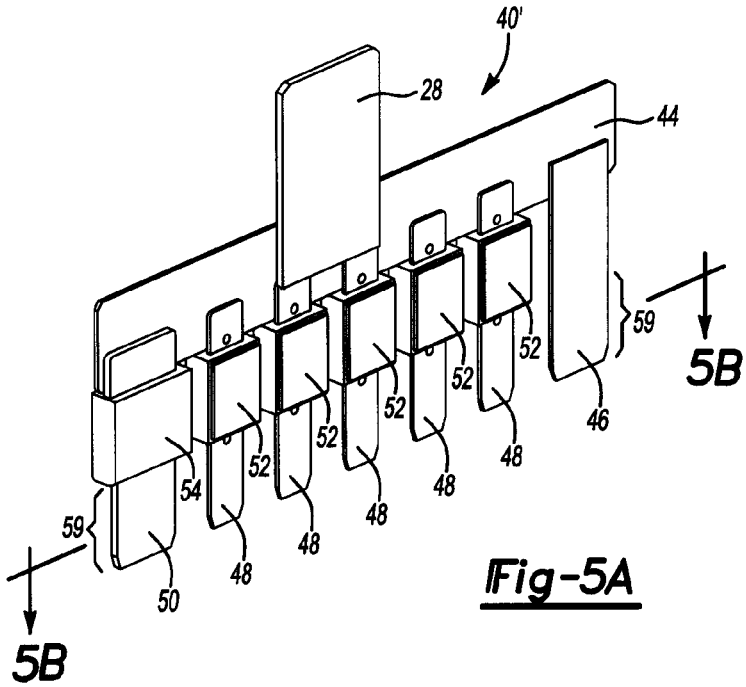
FIG. 5A is a perspective view of an example bus assembly.
Figure 5B:
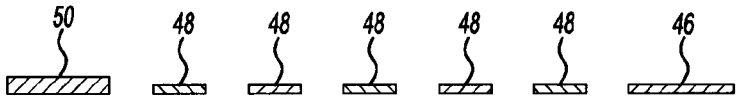
FIG. 5B is a top view, in cross-section, of the example bus assembly of FIG. 5A taken along line 5B-5B of FIG. 5A.

FIG. 5B is a top view, in cross-section, of bus assembly 44 taken along FIG. 5B-5B of FIG. 5A. As discussed above, blind tap 46 of FIG. 5B is wider than midi-taps 48, and mega-tap 50 of FIG. 5B is wider and thicker than midi-taps 48. In alternative embodiments, blind tap 46, midi-taps 48, and mega-tap 50 may have other cross-sections, e.g., bent, circular, etc., as desired.

Figure 6:
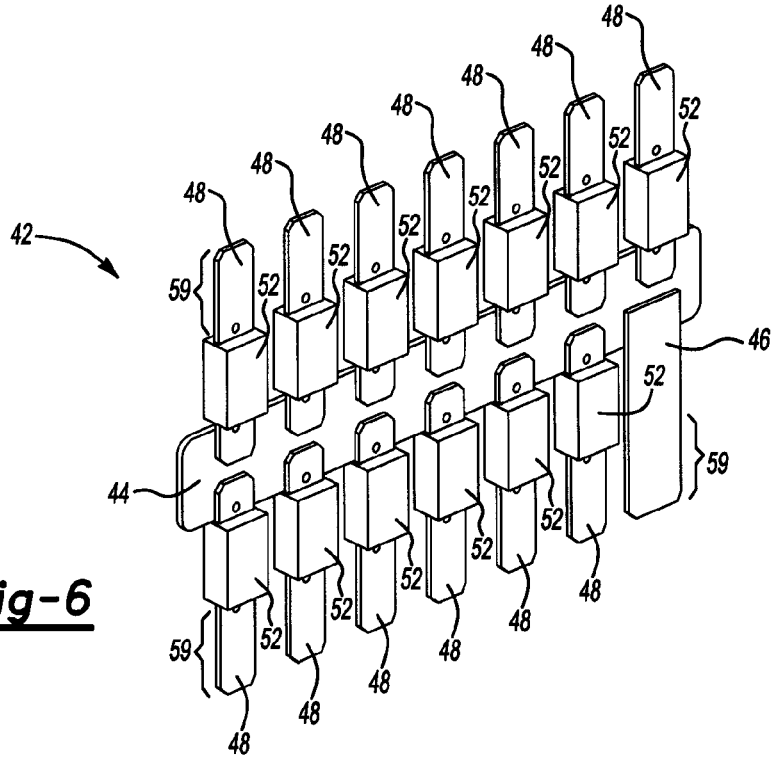
FIG. 6 is a perspective view of another example bus assembly.

FIG. 6 is a perspective view of bus assembly 42. Bus assembly 42, in certain ways, is similar to other bus assemblies described herein. Bus assembly 42, however, includes a second row of midi-taps 48. As such, power distribution box 30 may be hooked, for example, between wiring harnesses 43, 45 (FIG. 4) of an automotive vehicle.

Referring to FIG. 4, bus assembly 42' differs from bus assembly 42 at least because each row of taps of bus assembly 42' includes mega-tap 50 and mega-fuse 54.

Bus assemblies 38, 38', 40, 40', 42, 42' of FIG. 4 are assembled from a common set of components. For example, bus assemblies 38, 38', 40, 40', 42, 42' each include bus bar 44, blind tap 46, and several midi-taps 48. Other configurations of bus assemblies may be assembled from the common set of components described herein. For example, bus assemblies having fewer taps may be assembled.

Figure 7:
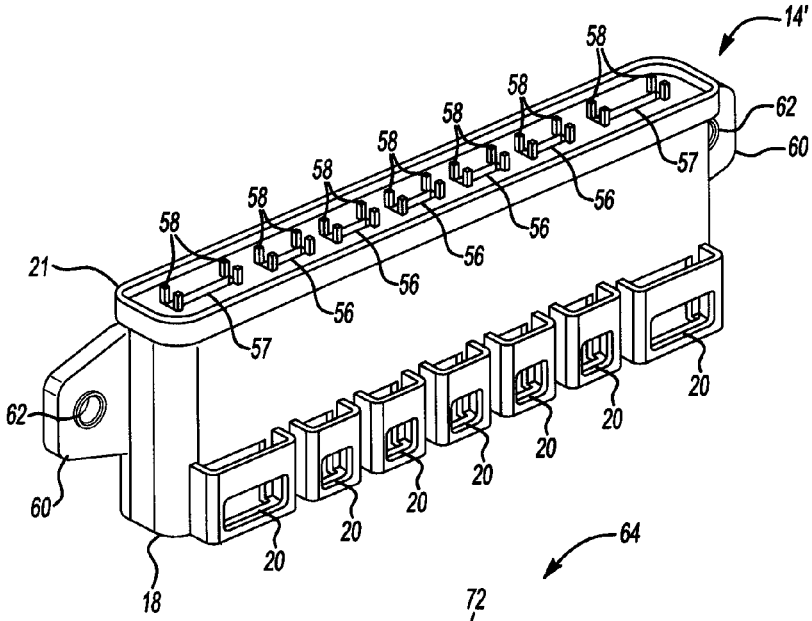
FIG. 7 is a perspective view of an example housing.

FIG. 7 is a perspective view of housing 14'. Housing 14' includes slots 56, 57 and guides 58. Slots 56, 57 receive slot portions 59 (FIGS. 5 and 6) of blind taps 46, midi-taps 48, and mega-taps 50. In the embodiment of FIG. 7, slots 57 are shaped to accommodate any of blind taps 46, midi-taps 48, and mega-taps 50, e.g., slots 57 have a width and length greater than a width and length of any of blind taps 46, midi-taps 48, and mega-taps 50. Slots 57 are also located on the ends of housing 14'. In alternative embodiments, there may be a fewer or greater number of slots 57 and they may be placed elsewhere. Slots 56 of FIG. 7 are shaped to accommodate midi-taps 48. Guides 58 guide blind taps 46, midi-taps 48, and mega-taps 50 into their respective slots when housing 14' is assembled with any of bus assemblies 38, 38', 40, 40', 42, 42'. Housing 14' includes tabs 60 with though holes 62 to permit housing 14' to be attached, e.g., bolted, screwed, etc., to other components of an automotive vehicle.

Referring to FIG. 4, housing 14 differs from housing 14' at least because housing 14 lacks tabs 60 with through holes 62.

Figure 8:
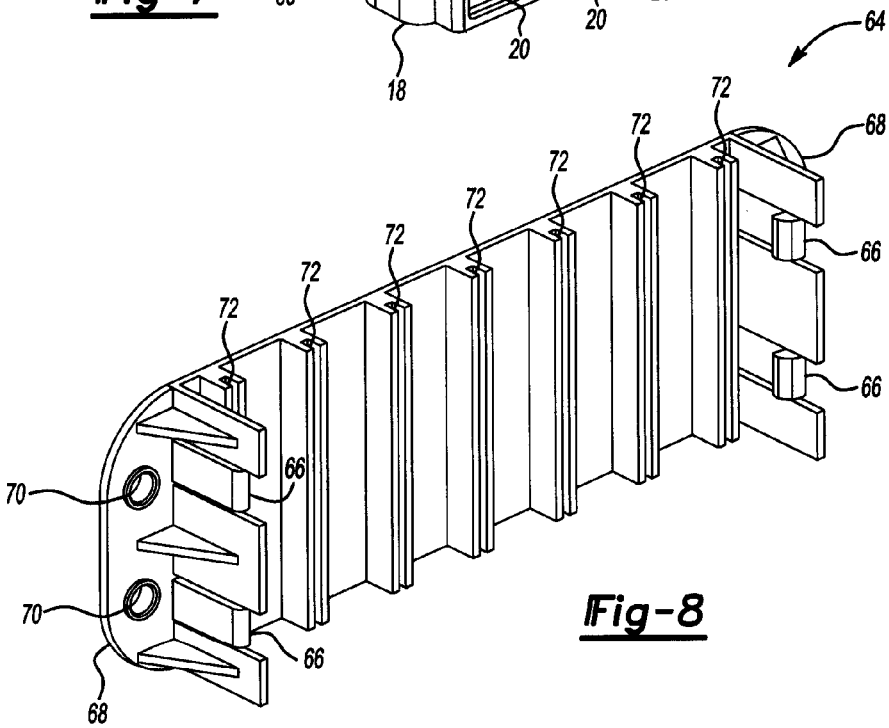
FIG. 8 is a perspective view of an example fixation bracket.

FIG. 8 is a perspective view of bracket 64. Bracket 64 includes clips 66, tabs 68 with through holes 70, and slots 72. Clips 66 clip to the ends of housing 32. Tabs 68 with though holes 70 permit bracket 64 to be attached to other components of an automotive vehicle. Slots 72 mate with ridges 33 (FIG. 3) of housing 32 (FIG. 3) to hold bracket 64 relative to housing 32.

In the embodiment of FIG. 8, bracket 64 is molded, e.g., injection molded, in plastic. Other manufacturing techniques may also be used.

Figure 9:
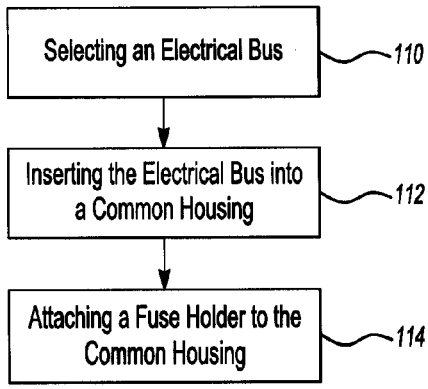
FIG. 9 is a flow chart of a method of assembling an electrical connector.

FIG. 9 is a flow chart of a method for assembling a power distribution box. At 110, an electrical bus is selected. For example, any of the electrical busses 38, 38', 40, 40', 42, 42' (FIG. 4) is selected. At 112, the selected electrical bus is inserted into a common housing. For example, electrical bus 38 is inserted into housing 14 (FIG. 4). At 114, a fuse holder is attached with the common housing. For example, fuse holder 12 (FIG. 4) is snapped to housing 14.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical connector for a wiring harness of an automotive vehicle comprising:

an electrical bus including a jumper tap to provide a contact patch for a jumper cable and having a row of contacts selected from the group including input tap, first output tap, and second output tap, wherein at least one of the taps has a configuration that is different than the other taps;

a housing including a row of slots configured to receive the row of contacts, wherein at least one of the slots is configured to receive any of the contacts selected from the group including input tap, first output tap, and second output tap;

a fuse holder including a snap feature and configured to surround the electrical bus, to permit at least a portion of the jumper tap to pass through the fuse holder, and to attach with the housing; and a removable cap configured to cover the jumper tap and to attach with the snap feature of the fuse holder.

2. The electrical connector of claim 1 wherein the electrical bus further includes an additional row of contacts selected from the group including first output tap and second output tap and wherein the first output tap has a configuration that is different than the second output tap.

3. The electrical connector of claim 2 further comprising an additional housing including a row of slots configured to receive the additional row of contacts wherein at least one of the slots is configured to receive any of the contacts selected from the group including first output tap and second output tap.

4. The electrical connector of claim 1 further comprising a bracket including a fixation feature for attaching the bracket to the automotive vehicle wherein the bracket is configured to attach with the fuse holder.

5. The electrical connector of claim 1 wherein the taps each have a width and wherein the width of the at least one tap having a configuration different than the other taps is different than the width of the other taps.

6. The electrical connector of claim 1 wherein the taps each have a cross section and wherein the cross section of the at least one tap having a configuration different than the other taps is different than the cross section of the other taps.

7. The electrical connector of claim 1 wherein the fuse holder further includes a fixation feature for attaching the fuse holder with the automotive vehicle.

* * * * *